US005123647A

United States Patent [19]

Lawlor et al.

[11] Patent Number: 5,123,647

[45] Date of Patent: Jun. 23, 1992

[54] INTERACTIVE PLAYFIELD FEATURE FOR PINBALL GAMES

[75] Inventors: Patrick M. Lawlor; Lawrence E. DeMar; John R. Krutsch, all of Chicago, Ill.

[73] Assignee: Williams Electronics Games, Inc., Chicago, Ill.

[21] Appl. No.: 691,707

[22] Filed: Apr. 26, 1991

[51] Int. Cl.[5] ..... A63F 7/30

[52] U.S. Cl. ..... 273/121 A; 273/127 R; 273/127 C; 273/127 D

[58] Field of Search ..... 273/118 R, 118 A, 121 R, 273/121 A, 127 R, 127 A, 127 B, 127 C, 127 D

[56] References Cited

U.S. PATENT DOCUMENTS

| | | | |
|---|---|---|---|
| 4,030,555 | 6/1977 | Boyce et al. | 273/121 A |
| 4,272,649 | 6/1981 | Pfeiffer | 273/121 A |
| 4,354,680 | 10/1982 | Kmiec | 273/121 A |
| 4,542,905 | 9/1985 | Hooker | 273/121 A |
| 4,620,706 | 11/1986 | Ijidakinro | 273/127 R |
| 4,763,256 | 8/1988 | DeMar | 273/121 A |
| 4,773,646 | 9/1988 | Joos, Jr. et al. | 273/127 R |
| 4,840,375 | 6/1989 | Lawlor et al. | 273/121 A |
| 4,934,699 | 6/1990 | Kaminkow et al. | 273/127 C |

OTHER PUBLICATIONS

"Popular Science" article, Aug. 1980, pp. 54–58, 116.

*Primary Examiner*—William H. Grieb
*Assistant Examiner*—Raleigh W. Chiu
*Attorney, Agent, or Firm*—Rockey and Rifkin

[57] ABSTRACT

The present invention is a computer-controlled interactive playfield feature for pinball games. The system microprocessor monitors activity on the playfield and controls the interactive playfield feature, directing the player's attention to specific targets and activities on the playfield. The playfield feature operates in conjunction with a speech synthesizer, which may be programmed to taunt and challenge game player, increasing player appeal. In a preferred embodiment, the interactive playfield feature is in the shape of a jocular human head. The mouth, eyelids and eyes are movable under microprocessor control. The mouth serves as a ball target. When the player successfully shoots the ball in the mouth, a solenoid ball ejector returns the ball to the playfield. The eyes may be programmed to follow the travel of the pinball on the playfield.

17 Claims, 6 Drawing Sheets

INTERACTIVE PLAYFIELD FEATURE FOR PINBALL GAMES

BACKGROUND AND OBJECTS OF THE INVENTION

The present invention relates generally to playfield features for pinball games, and more particularly to a multifunction interactive playfield feature for such games.

Pinball games, as commonly known, consist of an inclined playfield and a plurality of features arranged on the playfield. A player uses flippers or similar means to direct a pinball at the playfield features such as targets or ramps in order to score points. Even though a variety of pinball game features are currently in use, constant addition of novel and exciting features is desirable to attract the greatest possible number of players to a particular pinball game.

Conventional pinball games have playfield features that respond to contact by the pinball. These playfield features lack the capability to communicate with the game player and direct attention toward specific activities on the playfield. A playfield feature having the capability to interact with the game player is desirable.

Accordingly, it is a general object of the invention to provide an interactive playfield feature for pinball games.

It is a further object of the invention to provide such a playfield feature capable of interacting with the player during play of the game and attracting his attention to skill shots and similar activities on the playfield.

It is another object of the invention to provide such a playfield feature having the capability of responding to activity on the playfield via microprocessor control.

Other objects of the invention will become apparent to those skilled in the art from the detailed description of the invention provided below.

SUMMARY OF THE INVENTION

The present invention is a computer-controlled interactive playfield feature for pinball games. The system microprocessor monitors activity on the playfield and controls the interactive playfield feature, directing the player's attention to specific targets and activities on the playfield.

In a preferred embodiment, the interactive playfield feature is in the shape of a jocular human head. The mouth is operated by an electric motor under microprocessor control. In either the open or closed position, the mouth serves as a ball target toward which the player is encouraged to direct his skill shots. When closed, the lower lip prevents the ball from entering the mouth. When the player gets the ball in the open mouth, points are awarded and bonus features may be activated. A solenoid ball ejector returns the ball to the playfield. The mouth may be operated in conjunction with a speech synthesizer associated with the game's controlling microprocessor to give the appearance of speech. This function may be used to taunt and challenge game players, increasing player appeal.

The eyelids are movable, and are operated by solenoids in conjunction with mechanical linkages under microprocessor control to give the head a more lifelike appearance. The eyes are operated by a pair of pull-pull solenoids. Preferably, eye movement may be controlled so as to follow the path of the pinball as it travels on the playfield, responsive to playfield sensors, which indicate the ball position to the system microprocessor.

DETAILED DESCRIPTION OF A PREFERRED EMBODIMENT

Figure 1:
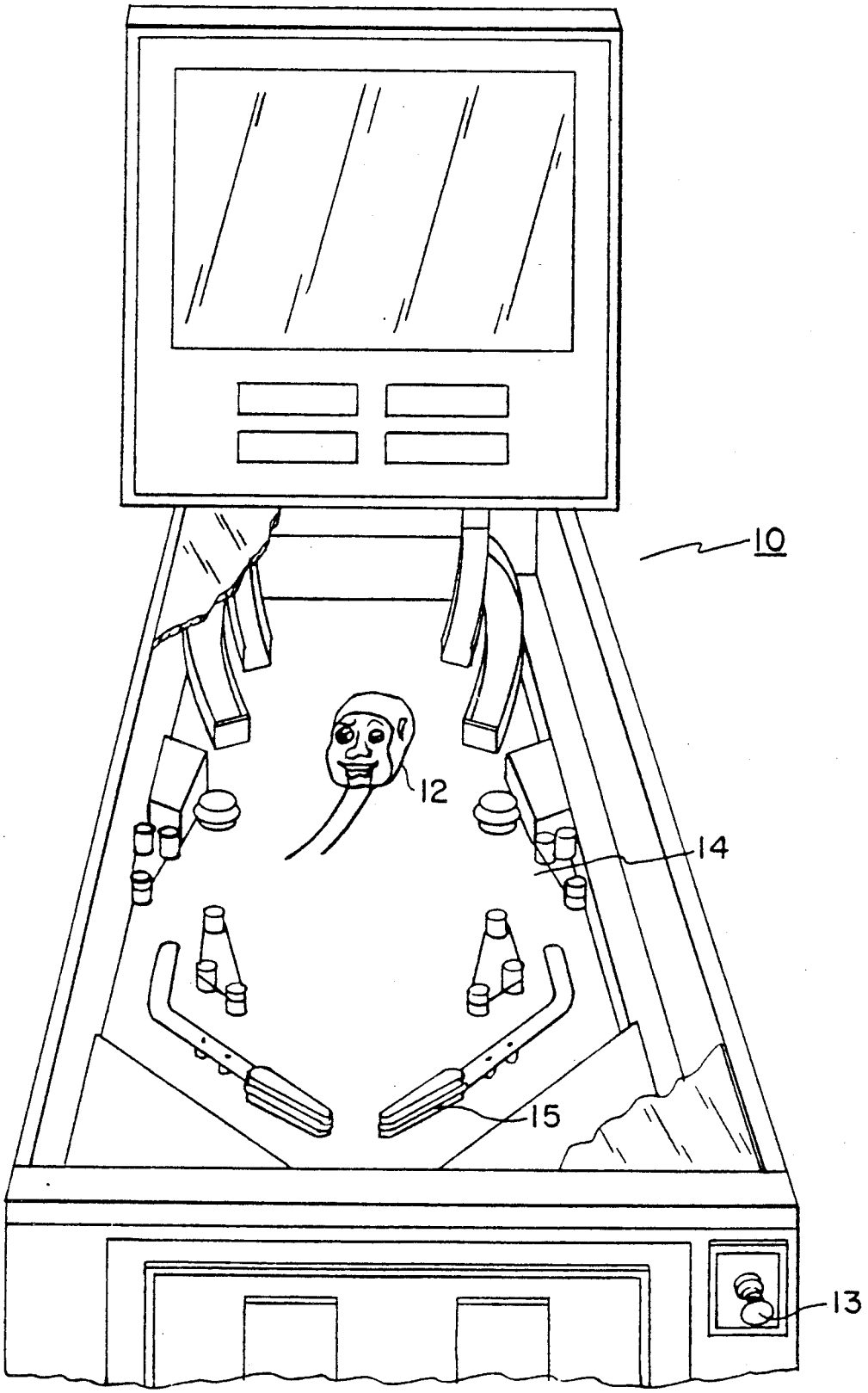
FIG. 1 is a perspective view of a pinball game having the interactive playfield feature of the present invention installed thereon.

Referring to the drawings, FIG. 1 shows a pinball game 10 having an interactive playfield feature 12 mounted on an inclined playfield 14. A spring-loaded plunger 13 is provided to allow the player to propel the ball onto the playfield 14. The playfield is equipped with a plurality of conventional playfield features, such as bumpers, ramps, and other targets, all of which have ball-activated sensors associated therewith. While mechanical switches and optical switches are commonly used for this purpose, it is within the contemplation of the invention that any means for signalling the presence of the ball may be substituted therefor. The game player may direct skill shots at these targets by controlling a set of flippers 15.

When the sensors are activated by the pinball during the course of play, points are awarded to the player. The use of pinball actuated switches for this purpose is well known in the art. As will be fully described hereinafter, the system microprocessor uses the input from these sensors to determine the position of the pinball on the playfield. This information is used to control the interactive playfield feature 12.

Figure 2:
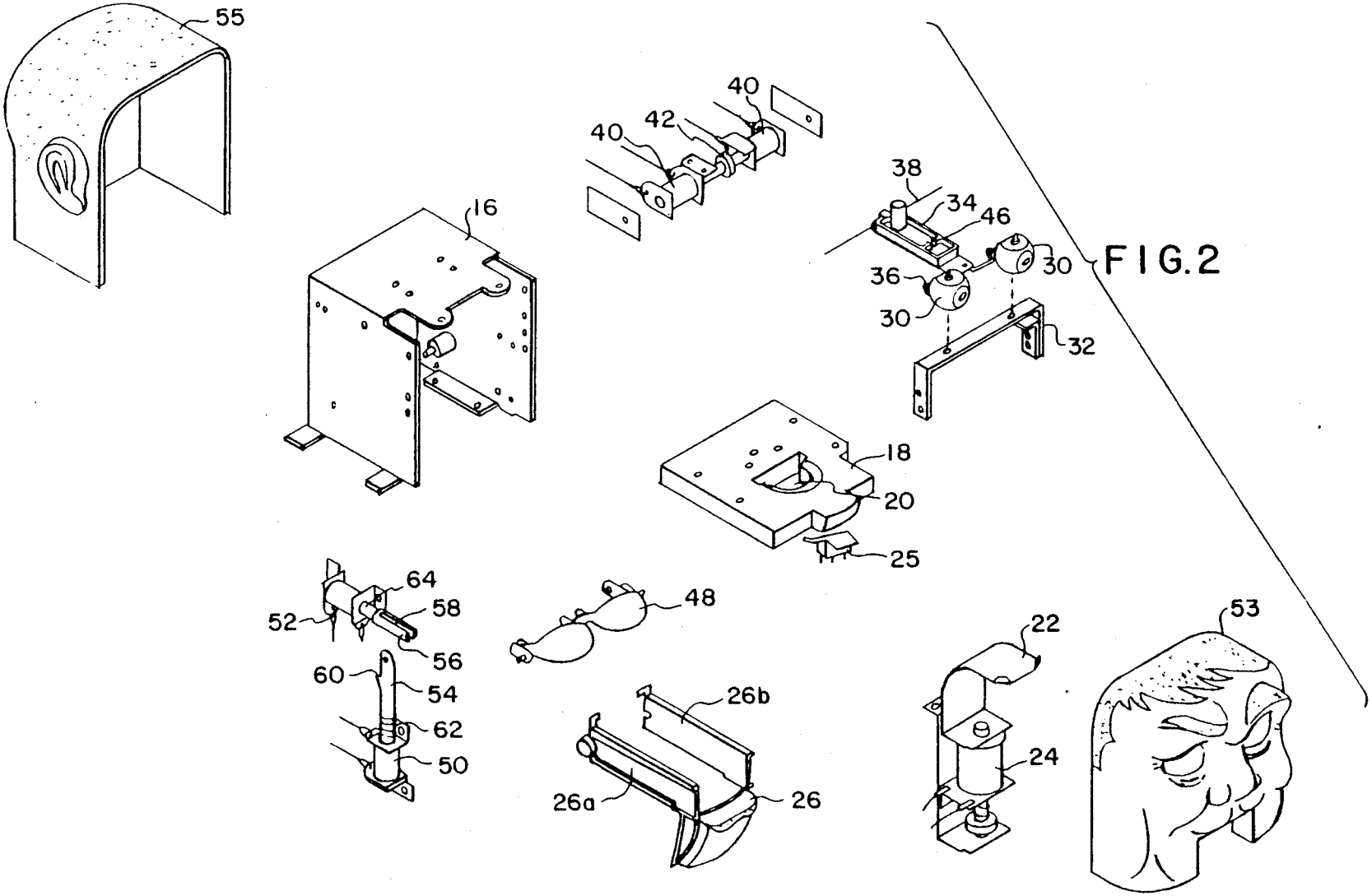
FIG. 2 is an exploded view of the interactive playfield feature of the present invention.
Figure 3:
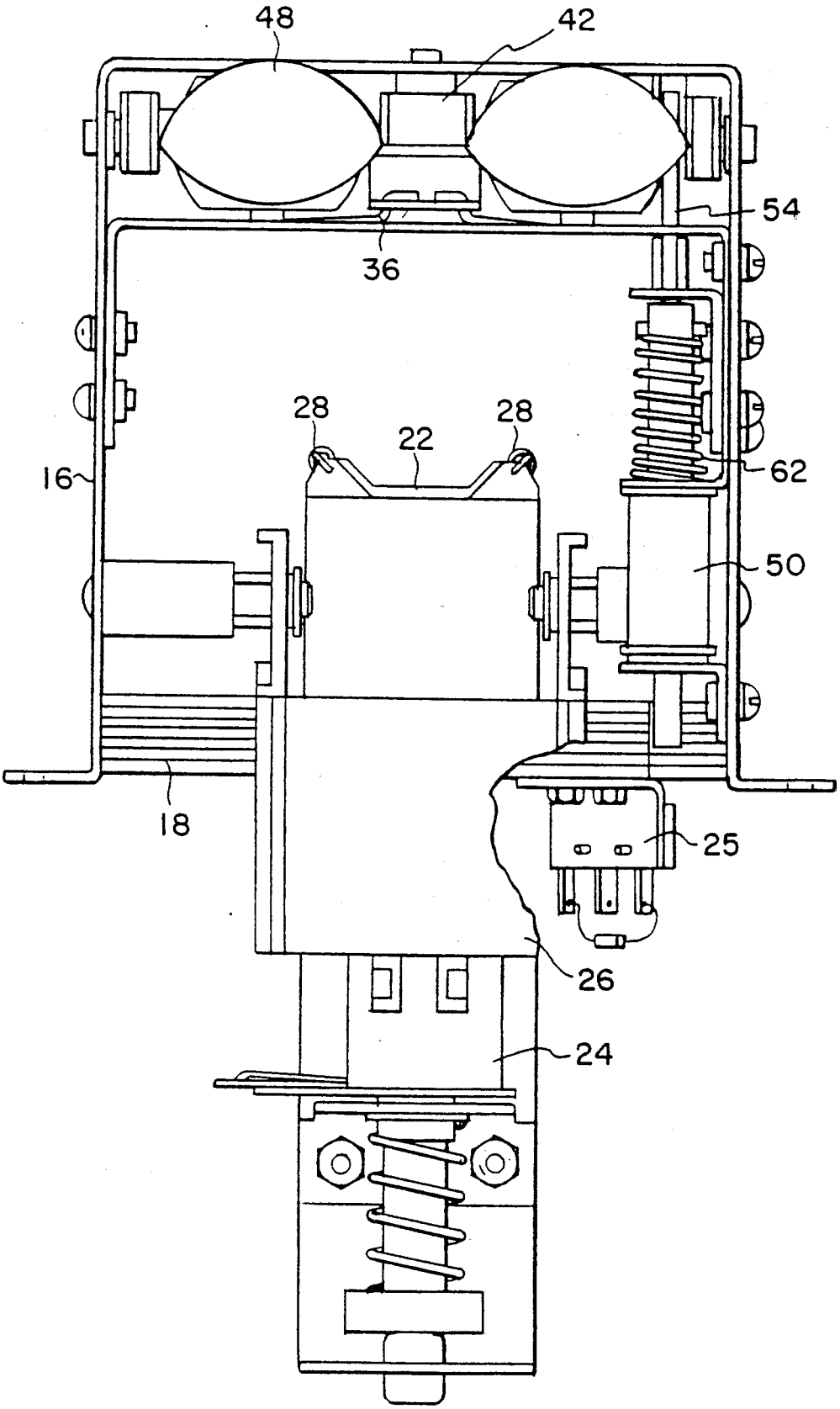
FIG. 3 is a front view of the interactive playfield feature of the present invention with the covers removed.
Figure 4:
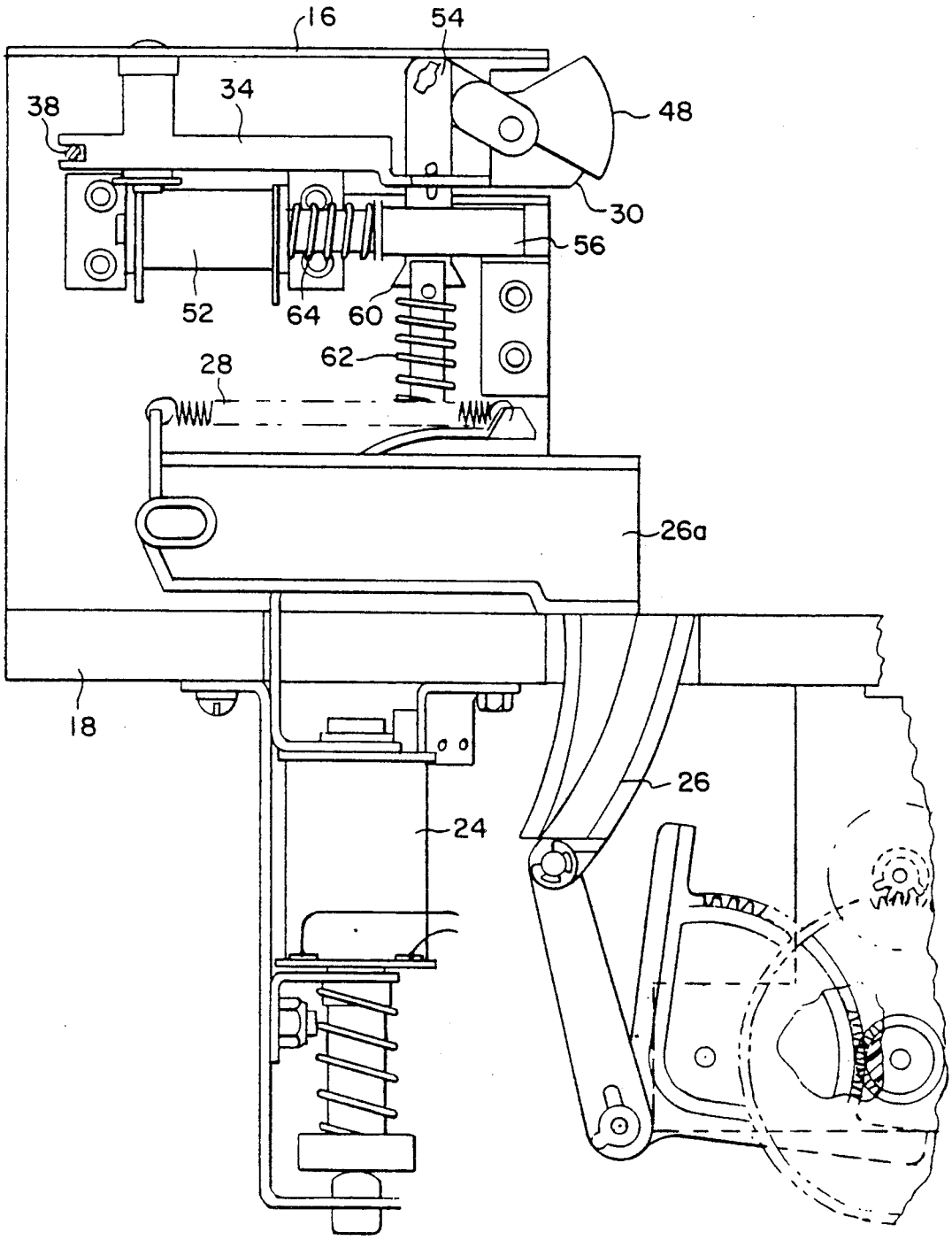
FIG. 4 is a side view of the interactive playfield feature of the present invention with the covers removed.
Figure 5:
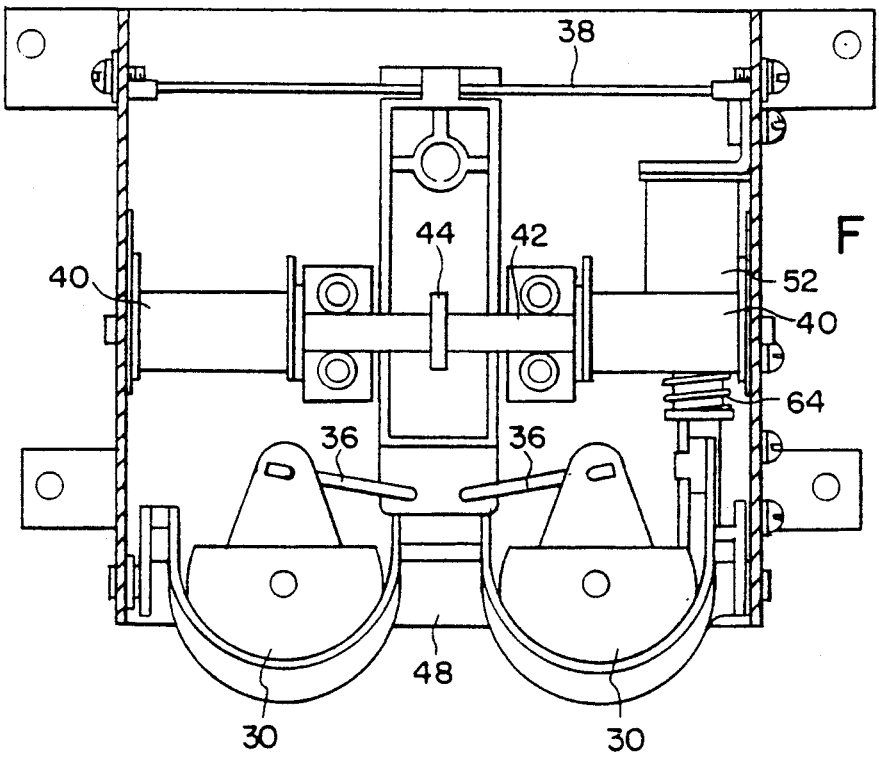
FIG. 5 is a top view of the interactive playfield feature of the present invention.

FIG. 2 shows an exploded view of the interactive playfield feature of the present invention. FIG. 3, FIG. 4 and FIG. 5 are also useful in explaining the construction of the present invention. The mechanical and electrical components comprising the interactive playfield feature are supported by a metal frame 16, which is secured to the playfield 14. A wooden panel 18 is secured within the frame 16, forming its bottom. The panel 18 has a centrally disposed aperture 20 for receiving the pinball during game play.

A ball trap assembly 22 is secured to the panel 18, extending upwardly through the aperture 20. The ball trap 22 receives a pinball, forcing it into the aperture 20. Secured to the ball trap 22 is a ball ejector solenoid 24, which returns the pinball to the playfield 14 after it is caught in the ball trap 22. A switch assembly 25 is secured to the bottom of the panel 18. The switch assembly 25 signals the system microprocessor when a pinball enters the ball trap 22.

A plastic mouth member 26 (see FIG. 4) is secured to the frame 16 for reciprocating pivotal motion between an upper position and a lower position, as well as any intermediate position. The mouth member 26 is driven by a motor and gear arrangement under microprocessor control, as is commonly known in the art. The mouth member 26 includes side members 26*a* and 26*b*, which form the sides of the ball trap. The mouth member 26 is biased forwardly by a pair of springs 28 connected between the ball trap 22 and the hinged ends of the side members 26*a* and 26*b*. The springs 28 provide a cushion so that shock is absorbed by the spring when the mouth member 26 is struck by the pinball during the course of play.

A pair of simulated eyes 30 are mounted for left and right pivoting motion on a bracket 32, which is secured within the frame 16. The eyes are connected to a lever arm 34 via a pair of linkage members 36 (see FIG. 5). The lever arm 34 is secured for pivotal motion to a point on the inside top of the frame 16. When the lever arm 34 is pivoted about this point, the eyes 30 are moved from side to side via the linkage members 36. A centering rod 38 is secured between the sides of the frame 16. The centering rod 38 abuts the end of the lever arm 34, so that it is displaced rearwardly whenever the eyes 30 are rotated in either direction. When no external force is applied to the lever arm 34, the centering rod 38 centers the lever arm 34, so that the eyes 30 point straight ahead.

A pair of solenoids 40 having a common plunger shaft 42 is secured in pull-pull configuration within the frame 16. A camming member 44 is disposed on the plunger 42 for cooperation with a slot 46 in the upper surface of the lever arm 34. The shaft 42 is reciprocated under microprocessor control. When power is supplied to one of the solenoids, the other solenoid remains unpowered. Thus, the shaft 42 is pulled toward the solenoid to which power is supplied. Power may be applied to the other solenoid 40 to cause the plunger shaft to travel in the opposite direction. As the plunger shaft travels from side to side, the camming member 44 engages the edges of the slot 46, rotating the lever arm 34, causing the eyes 30 to travel in the opposite direction of plunger shaft movement.

A pair of simulated eyelids 48 is mounted for reciprocal motion within the frame 16. The eyelids 48 are controlled by a pair of solenoids 50, 52, and may be positioned in either an open, closed or overdriven position under control of the system microprocessor. The vertically positioned solenoid 50 is secured to the side of the frame 16 and is connected to the eyelids by a rigid locking member 54. The solenoid 52 is horizontally positioned on the side of the frame 16 so that the plunger reciprocates in a direction perpendicular to the plunger of the solenoid 50. A latching arm 56 is attached to the plunger of the solenoid 52. The locking member 54 passes through a slot 58 in the latching arm 56. A tab 60 extends from the locking member 54. The tab 60 cooperates with the latching arm 56 to restrict the travel of the plunger of the solenoid 50. Springs 62 and 64 are concentrically disposed about the plungers of the solenoids 50 and 52 to bias them to a fully extended position in their de-energized state.

A molded plastic face 53 is secured to the front of the frame 16. The face 53 has apertures to accommodate the eyes 30, eyelids 48 and mouth 26. A molded plastic head 55 is secured to the back of the frame 16.

Figure 6A:
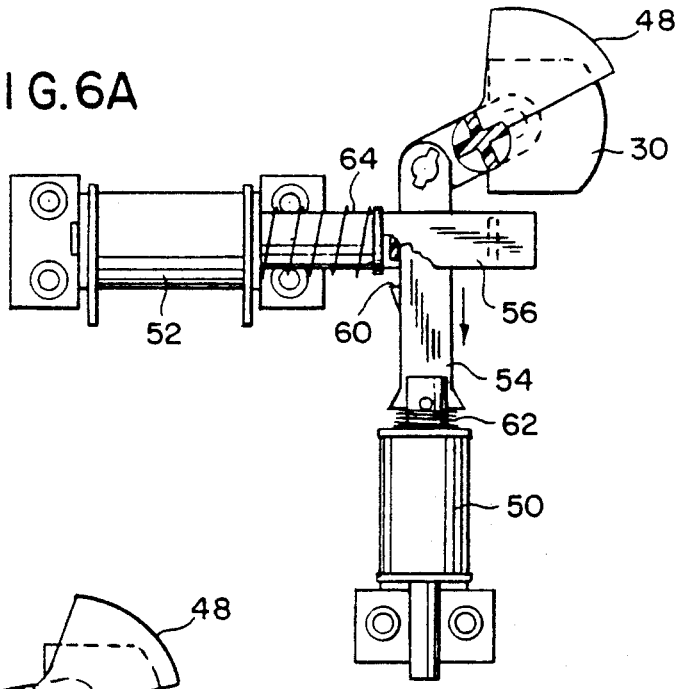
FIG. 6A, FIG. 6B and FIG. 6C are side views in partial section showing the operation of the solenoid-controlled plastic eyelids of the present invention.
Figure 6B:
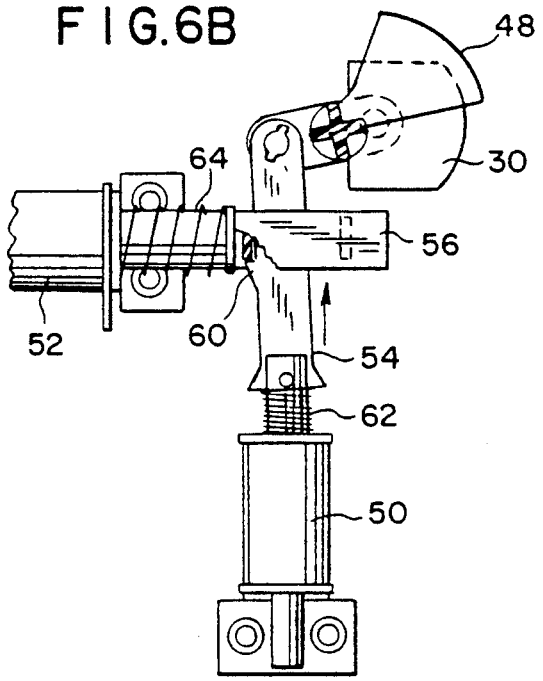
Figure 6C:
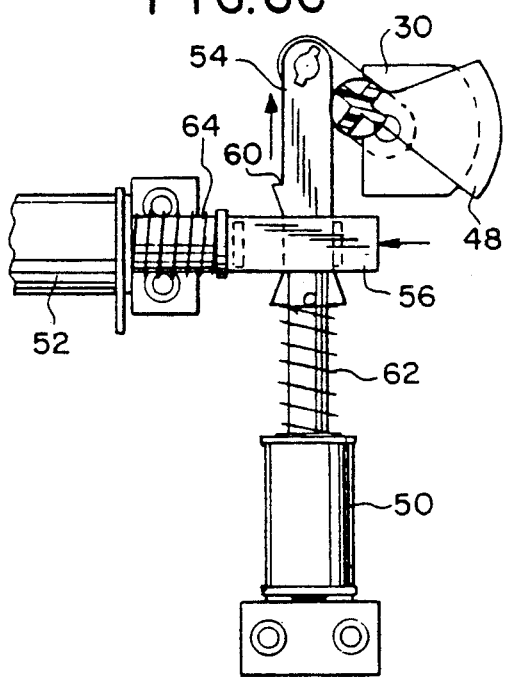

FIG. 6A, 6B and 6C are useful for explaining the operation of the eyelids 48. FIG. 6A shows the eyelids in a wide open position. To place the eyelids in this state, the solenoid 50 is overdriven by the system microprocessor, fully retracting its plunger. Thus, the eyelids 48 are reciprocated toward a fully open position. This overdriven position is useful in manifesting a surprised expression on the face of the interactive playfield feature of the present invention.

FIG. 6B shows the eyelids in an open position. In this state, the solenoid 52 must be unpowered to allow the spring 64 to bias the latching arm 56 to a fully extended position. Thus, the latching arm 56 is made to abut the edge of the locking member 54. When the solenoid 50 is de-energized, the spring 62 will bias its plunger toward fully extended position, causing the tab 60 to engage the latching arm 56. The engagement of the tab 60 with the latching arm 58 prevents further travel of the plunger of the solenoid 50, causing the eyelids to remain in the open position until the tab 60 is disengaged from the latching arm 56 by energizing the solenoid 52.

FIG. 6C shows the eyelids 48 in closed position. The solenoid 52 is energized while the solenoid 50 is de-energized. In this position, the tab 60 clears the latching arm 56 as the spring 62 returns the plunger of the solenoid 50 to fully extended position. The eyelids 48 are reciprocated to fully closed position.

Figure 7:
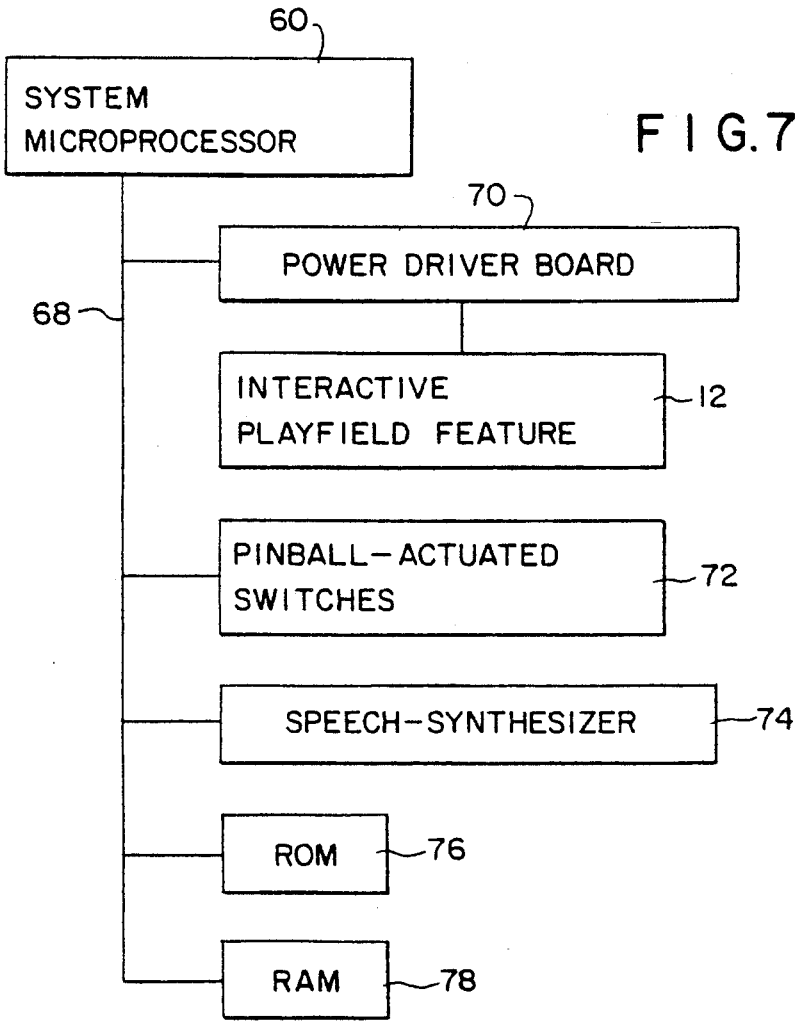
FIG. 7 is a block diagram useful in explaining the control of the interactive playfield feature of the present invention via the system microprocessor.

FIG. 7 is a block diagram useful in explaining the operation of the interactive playfield feature of the present invention. A system microprocessor 66 controls the interactive playfield feature 12 via a bus 68. This configuration is well-known in the art. The bus 68 also connects the microprocessor 66 to a plurality of pinball-actuated sensors 72, a speech synthesizer 74, a read-only memory ("ROM") 76 and a random access memory ("RAM") 78. The ROM 76 contains executable software which is used by the microprocessor 66 to control the operation of the pinball game, including the interactive playfield feature of the present invention.

As previously noted, the sensors 72 signal the microprocessor 66 when contacted by the pinball. The use of switches to update game scoring or activate playfield features is well-known in the art. For further background, reference is made to U.S. Pat. No. 4,763,256 to DeMar ("the DeMar patent"), which is hereby incorporated by reference. The DeMar patent teaches the monitoring of switches on the playfield to detect inoperative features. Additionally, switch closure information has been used to signal the system microprocessor to activate different playfield features when an active target is hit by the pinball.

In the present invention, the microprocessor 66 employs the switch closure information to determine the location of the pinball on the playfield. This may be accomplished, for example, by relating each switch to a specific co-ordinate location on playfield via a look-up table in the system ROM 76. The ROM 76 may store the co-ordinate locations of typical ball paths to allow the microprocessor 66 to anticipate the ball position and correct this estimate based on actual switch closure data.

Using the ball position information, the microprocessor 66 may be programmed to operate the interactive playfield feature 12 to give the appearance that the eyes 30 are following the travel of the pinball. This novel effect creates great player interest in the game. The eyelids 48 may be controlled to enhance the expression on the face 53, showing fear when the ball is in close proximity or mockery when the player misdirects a skill shot.

The microprocessor 66 may also operate the speech synthesizer 74 in conjunction with the mouth of the interactive playfield feature 14 to give the appearance that the playfield feature 14 is speaking to the player. These messages may taunt the player and encourage him to attempt to shoot the pinball into the mouth of the interactive playfield feature 14 or at various other activated targets. Because the microprocessor knows the location of the pinball from the sensor information, the comments of the interactive playfield feature can be tailored to reflect the current game status. The microprocessor 66 awards points for each successful skill shot.

The present invention has been described with respect to certain embodiments and conditions, which are not meant to limit the invention. Those skilled in the art will understand that variations from the embodiments and conditions described herein may be made without departing from the invention as set forth in the appended claims.

What is claimed is:

1. A pinball game comprising:

an inclined playfield for supporting a rolling pinball and a player-operated means for propelling the pinball at targets located on the playfield;

a plurality of pinball activated sensors associated with the targets, each producing a signal when activated by the pinball;

an interactive playfield feature including means for responding to the movement of the pinball as the pinball travels over the playfield and contacts the targets; and a microprocessor including means for receiving the signals from the sensors and means for determining the location of the pinball on the play-field based on the signals received, further including means for controlling the response of the interactive playfield feature as a function of the location of the pinball on the playfield.

2. The playfeature of claim 1, further including a means for audibly communicating with the player responsive to movement of the pinball on the playfield.

3. The playfeature of claim 2, wherein said means for audibly communicating includes a speech synthesizer controlled by the microprocessor.

4. The pinball game of claim 1, further including a system memory accessible by the microprocessor, the means for determining location of the pinball further including a look-up table stored in the system memory.

5. The pinball game of claim 1, wherein the interactive playfield feature includes a simulated human head.

6. The pinball game of claim 1, wherein the means for responding includes a moveable mechanical assembly simulating human eyes.

7. The pinball game of claim 1, wherein the means for responding includes a moveable mechanical assembly simulating a human jaw.

8. The pinball game of claim 7 wherein the means for responding further includes a speech synthesizer controlled by the microprocessor, the jaw being controlled in conjunction with the speech synthesizer to give the appearance that the speech is coming from the jaw.

9. The pinball game of claim 7 including means for moving the jaw between a first position and a second position where a target is revealed at which the player may direct the pinball.

10. A pinball game comprising:

an inclined playfield for supporting a rolling pinball and a player-operated means for propelling the pinball at targets located on the playfield, a plurality of sensors located on the playfield for producing a signal when activated by the pinball;

an interactive playfield feature including means for responding to the movement of the pinball as the pinball travels over the playfield and activates the sensors, said means for responding including a simulated head having a moveable jaw;

means for audibly communicating with the player in response to the sensors activated by the pinball;

means for receiving the signals from the sensors and for determining the location of the pinball on the playfield based on the signal received; and means for controlling the means for responding and the means for audibly communicating as a function of the location of the pinball on the playfield.

11. A pinball game of claim 10, wherein the means for audibly communicating includes a speech synthesizer.

12. The pinball game of claim 11, wherein the means for controlling moves the jaw and controls the speech synthesizer to give the appearance that the head is talking.

13. The pinball game of claim 10, wherein said means for responding includes a first moveable mechanical assembly constructed to simulate eyes.

14. The pinball game of claim 13, wherein said means for responding further includes a second moveable mechanical assembly constructed to simulate eyelids.

15. The pinball game of claim 14, wherein the means for controlling moves the first and second moveable mechanical assemblies in response to the location of the pinball on the playfield to give the appearance that the simulated eyes are following movement of the pinball.

16. The pinball game of claim 10, further including a target means, said moveable jaw being disposed in front of said target means and can move between a first position where the target means is exposed to the pinball and a second position where the target means is concealed from the pinball.

17. The pinball game of claim 16, wherein the target means includes a ball trap and an ejector means.

* * * * *